US009885165B2

(12) United States Patent
Gunter

(10) Patent No.: US 9,885,165 B2
(45) Date of Patent: Feb. 6, 2018

(54) DECK DRAIN AND METHOD OF MANUFACTURE

(71) Applicant: ABT, INC., Troutman, NC (US)

(72) Inventor: Charles E. Gunter, Mooresville, NC (US)

(73) Assignee: ABT, INC., Troutman, NC (US)

( * ) Notice: Subject to any disclaimer, the term of this patent is extended or adjusted under 35 U.S.C. 154(b) by 0 days.

(21) Appl. No.: 14/777,428

(22) PCT Filed: Mar. 17, 2014

(86) PCT No.: PCT/US2014/030452
§ 371 (c)(1),
(2) Date: Sep. 15, 2015

(87) PCT Pub. No.: WO2014/145649
PCT Pub. Date: Sep. 18, 2014

(65) Prior Publication Data

US 2016/0040382 A1 Feb. 11, 2016

Related U.S. Application Data

(60) Provisional application No. 61/794,991, filed on Mar. 15, 2013.

(51) Int. Cl.
*E01C 11/22* (2006.01)
*E02B 11/00* (2006.01)

(52) U.S. Cl.
CPC ..... *E02B 11/005* (2013.01); *E01C 11/227* (2013.01); *E01C 11/22* (2013.01)

(58) Field of Classification Search
CPC ..... E01C 11/22; E01C 11/224
(Continued)

(56) References Cited

U.S. PATENT DOCUMENTS 696,792 A * 4/1902 Bedell ..... E01F 9/541 404/7
1,430,094 A 9/1922 Meier
(Continued)

FOREIGN PATENT DOCUMENTS

JP 2008-163707 * 7/2008
WO WO 2012/073123 A1 6/2012
WO 2014145649 A1 9/2014

OTHER PUBLICATIONS

International Search Report and Written Opinion of International Application No. PCT/US2014/030452 dated Aug. 8, 2014. English Language. 12 pages.

(Continued)

*Primary Examiner* — Sunil Singh
(74) *Attorney, Agent, or Firm* — Moore & Van Allen PLLC; Henry B. Ward, III

(57) ABSTRACT

Embodiments of the present invention include apparatus and methods relating to a drainage channel comprising two half members further comprising overhangs extending away from the half member along the length of the half member, wherein the overhang features alternating protrusions and recesses at regular distances along the length of the overhang and wherein the first half member and the second half member are joined together by the recesses of the first half member receiving the protrusions of the second half member and the recesses of the second half member receiving the protrusions of the first half member; and wherein the interior edges of the first half member and the second half member define a channel.

9 Claims, 2 Drawing Sheets

(58) Field of Classification Search
USPC ..... 404/2, 4; 405/36, 43, 44, 47
See application file for complete search history.

(56) References Cited

U.S. PATENT DOCUMENTS

| | | | | |
|---|---|---|---|---|
| 2,014,972 | A | 9/1935 | Lacey | |
| 4,105,051 | A | 8/1978 | Visentin | |
| 5,653,553 | A | 8/1997 | Gunter | |
| 7,044,169 | B2 * | 5/2006 | Kondou | B21C 37/107 138/166 |
| 2005/0238435 | A1 * | 10/2005 | Wallace | E01C 19/506 405/118 |
| 2007/0099782 | A1 | 5/2007 | Saadi et al. | |

OTHER PUBLICATIONS

Canadian Office Action for Canadian Patent Application No. 2,906,866 dated Jun. 21, 2016 (Search conducted on Jun. 20, 2016).

* cited by examiner

DECK DRAIN AND METHOD OF MANUFACTURE

CROSS-REFERENCE TO RELATED APPLICATIONS

This application is a continuation of U.S. Provisional Application No. 61/794,991, filed Mar. 15, 2013, entitled "Deck Drain and Method Manufacture," the contents of which is hereby incorporated by reference in its entirety.

BACKGROUND

Conventional drainage channels typically comprise a hollow molded concrete member with the channel being defined by the contours of the concrete member. Such drainage channels are difficult to shape to varying drainage paths, do not scale efficiently and are difficult to ship. Accordingly, there is a long-held but unmet need for drainage channels that are adaptable, scalable and easy to transport.

BRIEF DESCRIPTION OF THE DRAWINGS

The following detailed description of embodiments refers to the accompanying drawings which illustrate specific embodiments of the disclosure. Other embodiments having different structures and operations do not depart from the scope of the present disclosure.

DETAILED DESCRIPTION OF EMBODIMENTS OF THE INVENTION

Figure 1:
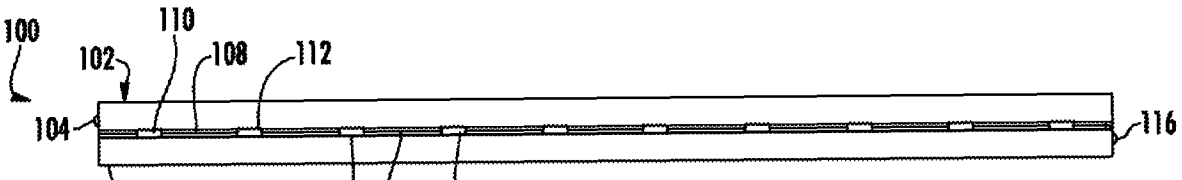
FIG. 1 shows a top elevation view of an embodiment of the present invention.

Embodiments of the present invention address the above needs by providing an improved deck drain and method of manufacturing and installing the same. Referring to the drawings, where like reference numerals refer to the same or similar parts, FIG. 1 provides a top elevation view of an embodiment of the present invention. As shown, the drainage channel is comprised of two half members 102 and 114. A projection 104 extends longitudinally from the proximal end of the first half member 102. A depression (see FIG. 4 at 106) corresponding to the size and shape of the projection 104 is located on the distal end of the first half member 102. The first half member 102 features an overhang 108 extending away from the first half member 102 along the length of the first half member 102 adjacent to the top of the first half member 102. The overhang 108 is interrupted at regular distances by alternating protrusions 110 and recesses 112. The second half member 114 is a mirror image of the first half member 102. The second half member 114 features a projection 116 extending longitudinally from the distal end of the second half member 114. A depression (see FIG. 2 at 118) corresponding to the size and shape of the projection 116 is located on the proximal end of the second half member 114. The second half member 114 features an overhang 120 extending away from the second half member 114 along the length of the second half member 114 adjacent to the top of the second half member 114. The overhang 120 of the second half member 114 is interrupted at regular distances by alternating protrusions 122 and recesses 124. The protrusions 122 of the second half member occur at the same longitudinal distances from the proximal end of the second half member 114 as the recesses 112 of the first half member 102. The recesses 124 of the second half member 114 occur at the same longitudinal distances from the proximal end of the second half member 114 as the protrusions 110 of the first half member 102.

Figure 2:
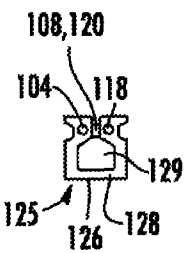
FIG. 2 shows an elevation view of the proximal end of the drainage channel formed by joining the first half member and second half member of an embodiment of the present invention.

FIG. 2, shows an elevation view of the proximal end of the first half member 102 and second half member 114 joined together. As shown, the projection 104 is located adjacent to the top of the first half member 102 and the depression 118 is located adjacent to the top of the second half member 114. The overhang 108, which as shown, extends inwardly, away from the first half member 102 and is located adjacent to the top of the first half member 102. The overhang 120 of the second half member 114 similarly extends inwardly away from the second half member 114 and is located adjacent to the top of the second half member 114. The two overhangs 108 and 120 meet to form a nearly solid member. The base 126 of the first half member 102 and the base 128 of the second half member 114 also extend inwardly and meet to form a nearly solid member. The contour formed by the interior edges of the first half member 102 and the second half member 114 define a channel 129.

Figure 3:
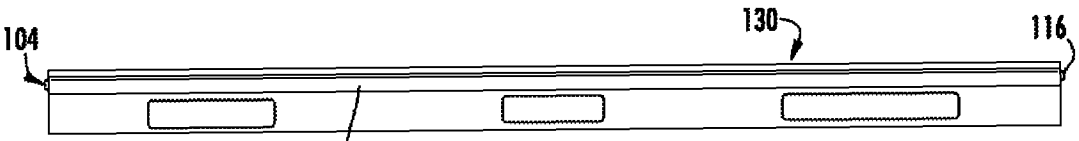
FIG. 3 shows an elevation view of a side of the drainage channel formed by joining the first half member and second half member of an embodiment of the present invention

FIG. 3 is an elevation view of a side of the drainage channel formed by joining the first and second half members. Inasmuch as the first and second half members are mirror images of the each other, both half members will feature similar elements to those shown in 130. As shown, the half member features a groove 132 running longitudinally adjacent to the top of the half member. The projections 104 and 116 can be seen at the distal and proximal ends of the drainage channel.

Figure 4:
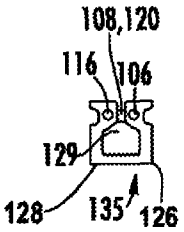
FIG. 4 shows an elevation view of the distal end of the drainage channel formed by joining the first half member and second half member of an embodiment of the present invention.

FIG. 4 is an elevation view of the distal end of the first half member 102 and second half member 114 joined together. As shown, the projection 116 is located adjacent to the top of the second half member 114 and the depression 106 is located adjacent to the top of the first half member 102. The overhang 120, which as shown, extends inwardly, away from the second half member 114 and is located adjacent to the top of the second half member 114. The overhang 108 of the first half member 102 similarly extends inwardly away from the first half member 102 and is located adjacent to the top of the first half member 102. The two overhangs 108 and 120 meet to form a nearly solid member. The base 126 of the first half member 102 and the base 128 of the second half member 114 also extend inwardly and meet to form a nearly solid member. The contour formed by the interior edges of the first half member 102 and the second half member 114 define a channel 129. It will be understood that the size of the channel 129 can be made larger or smaller by changing the size of the first and second half members and/or the contours formed by the interior edges of the first and second half members.

Figure 5:
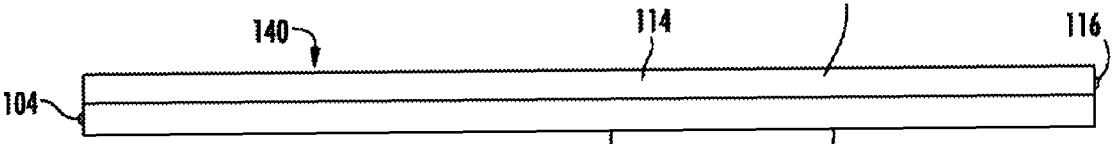
FIG. 5 shows an elevation view of the bottom of a drainage channel formed by joining the first half member and second half member of an embodiment of the present invention.

FIG. 5 is an elevation view of the bottom of a drainage channel formed when the first half member 102 and second half member 114 are joined together. As shown, the base 126 of the first half member 102 and the base 128 of the second half member 114 extend inwardly and meet to form a nearly solid member. The projection 104 can be seen extending from the proximal end of the first half member 102 and the projection 116 can be seen extending from the distal end of the second half member 114.

Figure 6:
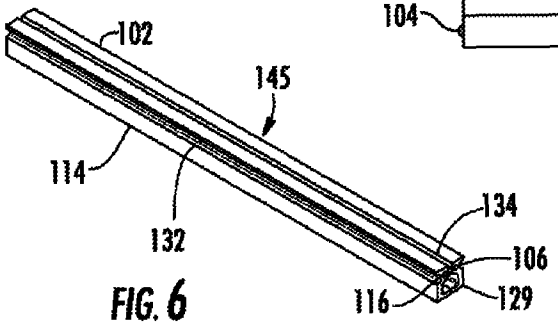
FIG. 6 shows a perspective view of an embodiment of the present invention.

FIG. 6 is a perspective view of the drainage channel formed when the first half member 102 and the second half member 114 are joined together. The first half member 102 is joined to the second half member 114 when the protrusions 110 of the first half member 102 are received by the recesses 124 of the second half member 114 and the protrusions 122 of the second half member 114 are received by the recesses 112 of the first half member 102 and the respective overhangs 108,120 are directly adjacent to each other creating a seal between the first half member 102 and the second half member 114. As the top portions of the first half member 102 and second half member 114 come together the base 126 of the first half member 102 meets the base 128 of the second half member 114 and also forms a seal. The contour formed by the interior edges of the first half member 102 and the second half member 114 define a channel 129.

As shown, when the first and second half members are joined together, in some embodiments, an indentation 134 is defined by the contours of the top of the first and second half members and the upward facing surface created by the joined overhangs. This indentation 134 runs longitudinally along the top of the drainage channel.

In use, surface water or water from other drains will be directed into the channel 129 and water will flow the length of the channel formed by the two half members. Multiple sections of drainage channel can be joined together by inserting projections 104 and 116 into depressions 106 and 118. When the depressions receive the projections a nearly solid member is formed. The drain is formed by removing soil to form a sloping trench along the intended path of the drain. Lengths of drainage channel are placed along the path and are joined together as described above. Concrete is then poured around the drainage channel. The concrete fills in the groove 132 on the sides of the first and second half members and the indentation 134 running along the top of the drainage channel. As the concrete hardens the resulting forces apply inward pressure along the drainage channel further strengthening the seal of the first and second half members. Water is funneled to the first opening of the drainage channel by means of slot drains, natural run-off or other known methods of redirecting water. The water then travels through each section of drainage channel to its intended destination, such as the sewer system, a drainage pond and the like.

Figure 7:
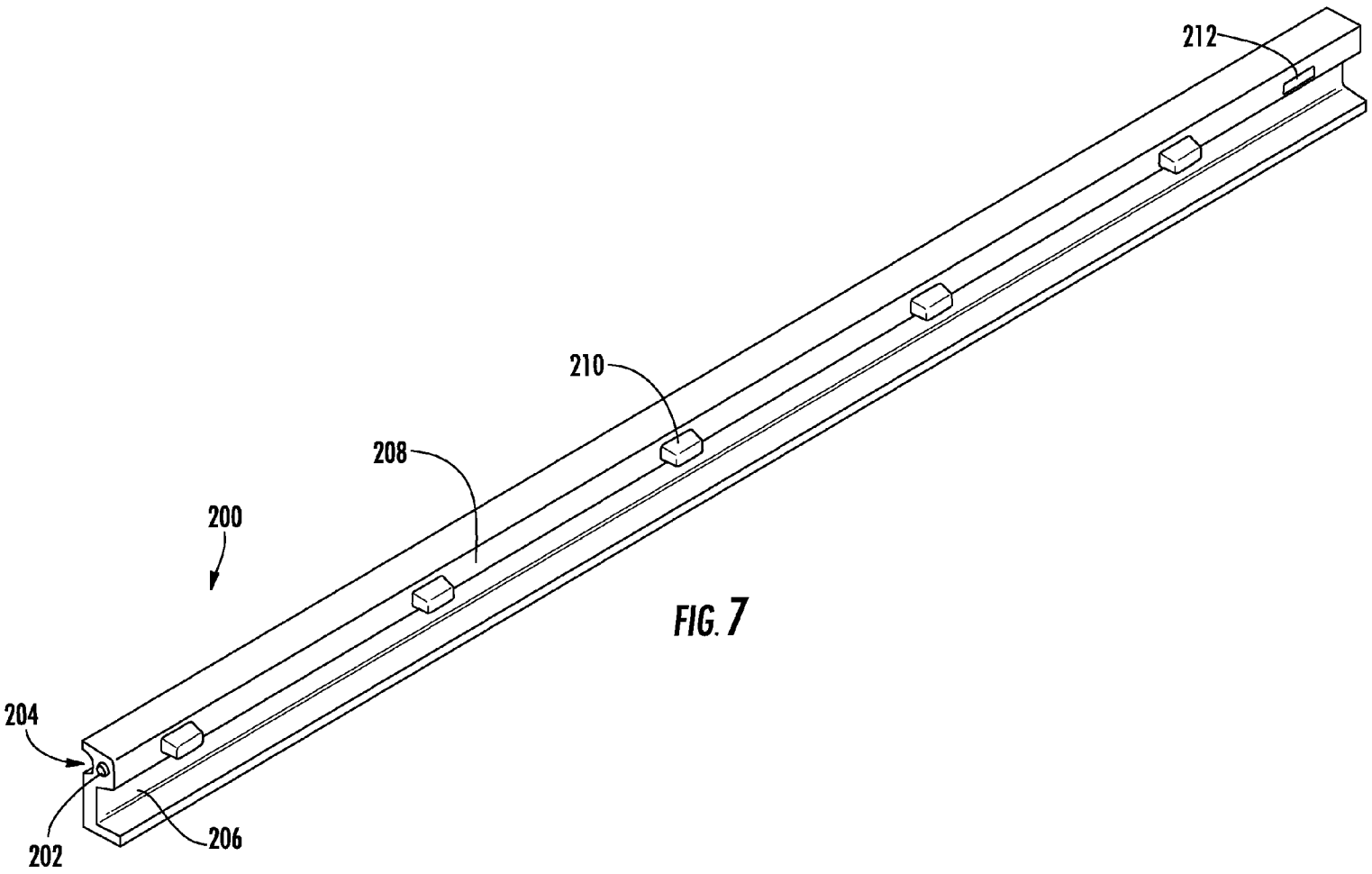
FIG. 7 shows a perspective view of a half member of an embodiment of the present invention.

Referring now to FIG. 7, which shows a perspective view of a half member 200 of an embodiment of the present invention. As shown, a projection 202 extends from the proximal end of the half member 200. Adjacent to this projection is the outline of a groove 204 the runs longitudinally along the back of the half member 200. The edges of the interior of the half member 200 define a cavity 206 that travels longitudinally along the length of the half member 200. In certain embodiments, the height of the cavity 206 is approximately two thirds of the total height of the half member 200. Adjacent to the top of the cavity 206 is a surface 208 running the length of the half member 200 and forming the interior edge of the top portion of the half member 200. At regular distances along this surface 208 are protrusions 210 extending away from the surface. At the distal end of the half member 200 is a recess 212. The other half member (not shown) is a mirror image of the half member 200 illustrated in FIG. 7 and includes recesses to receive the multiple protrusions 210 of the illustrated half member 200 and a protrusion to be received by the shown recess 212. The other half member 200 also features a cavity that mirrors the cavity 206 of the illustrated half member 200. When the two halves are joined together the top surfaces of the half members create a seal and the two cavities define a channel.

The drainage channels described and anticipated herein can be manufactured by forming a mold for each half member. In some embodiments a polymer concrete is poured into the molds creating the half members described above. However, concrete, plastics and other materials suitable for transporting water can be used. By forming the drainage channel from half members less polymer concrete (or other material) can be used to form the respective halves than would be required to mold a solid drainage channel. It will be understood that the size of the mold can be changed to create larger (or smaller) drainage channels without deviating from the primary features described herein. Similarly, the length of each section of drainage channel can be adjusted as needed for a particular use.

Inasmuch as the drainage channels are formed in half members the components of the drainage channel are smaller and can be transported more easily. For instance, half members of the drainage channel may be stacked one on top of the other without damaging to the drainage channel whereas previously the size and weight of a fully formed channel may have prevented stacking in shipment.

This application is intended to cover any adaptations or variations of the present disclosure. The following claims are in no way intended to limit the scope of the disclosure to the specific embodiments described herein.

What is claimed is:

1. A drainage channel, comprising:

a first half member comprising (i) an overhang extending away from the first half member along the length of the first half member, wherein the overhang features alternating protrusions and recesses at regular distances along the length of the overhang, and (ii) a groove extending lengthwise along an exterior surface of the first half member; and a second half member comprising (i) an overhang extending away from the second half member along the length of the second half member, wherein the overhang features alternating recesses and protrusions at regular distances along the length of the overhang, and (ii) a groove extending lengthwise along an exterior surface of the second half member, wherein the first half member and the second half member are joined together by the recesses of the first half member receiving the protrusions of the second half member and the recesses of the second half member receiving the protrusions of the first half member, wherein the interior edges of the first half member and the second half member define a channel, wherein the overhangs of the first half member and the second half member join together to create an upward facing surface, wherein the upward facing surface defines an indentation, and wherein the indentation and the grooves of the first and second half members are structured to be filled with concrete in order to secure the first and second half members together.

2. The drainage channel according to claim 1, wherein the first and second half members comprise polymer concrete.

3. The drainage channel according to claim 1, wherein the first and second half members comprise concrete.

4. The drainage channel according to claim 1, wherein the first and second half members each comprise first and second ends, wherein the first end of the first half member corresponds to the first end of the second half member and the second end of the first half member corresponds to the second end of the second half member, wherein the first end of the first half member defines a projection and the second end of the first half member defines a depression, and wherein the first end of the second half member defines a depression and the second end of the second half member defines a projection.

5. The drainage channel according to claim 4, further comprising a pair of joined first and second half members comprising first and second drainage channel segments, wherein first end of the first drainage channel segment is joined to the second end of the second drainage channel segment by inserting the projection on the first end of the first half member of the first drainage channel segment into the depression on the second end of the first half member of the second drainage channel segment and by inserting the projection on the second end of the second half member of the second drainage channel segment into the depression on the first end of the second half member of the first drainage channel segment.

6. A method of channeling water, comprising:

removing soil to form a drainage path;

placing in the drainage path a drainage channel comprising:

a first half member comprising an overhang extending away from the first half member along the length of the first half member, wherein the overhang features alternating protrusions and recesses at regular distances along the length of the overhang, and a second half member comprising an overhang extending away from the second half member along the length of the second half member, wherein the overhang features alternating recesses and protrusions at regular distances along the length of the overhang, wherein the first half member and the second half member are joined together by the recesses of the first half member receiving the protrusions of the second half member and the recesses of the second half member receiving the protrusions of the first half member, wherein the interior edges of the first half member and the second half member define a channel, and wherein the overhangs of the first half member and the second half member join together to create an upward facing surface;

pouring concrete around the drainage channel to fill with concrete (i) grooves extending lengthwise along an exterior surface of the first and second half members, and (ii) an indentation running along the top of the drainage channel formed by the upward facing surface; and directing water to an initial opening of the drainage channel.

7. The method of channeling water according to claim 6, wherein the first and second half members each comprise first and second ends, wherein the first end of the first half member corresponds to the first end of the second half member and the second end of the first half member corresponds to the second end of the second half member, wherein the first end of the first half member defines a projection and the second end of the first half member defines a depression, wherein the first end of the second half member defines a depression and the second end of the second half member defines a projection and further comprising:

providing a pair of joined first and second half members comprising first and second drainage channel segments, and joining the first and second drainage channel segments by inserting the projection on the first end of the first half member of the first drainage channel segment into the depression on the second end of the first half member of the second drainage channel segment and by inserting the projection on the second end of the second half member of the second drainage channel segment into the depression on the first end of the second half member of the first drainage channel segment.

8. A method of manufacturing drainage channels, comprising:

creating a first mold for forming a first half member of a drainage channel that features (i) an overhang extending away from the first half member along the length of the first half member, wherein the overhang features alternating protrusions and recesses at regular distances along the length of the overhang, and (ii) a groove extending lengthwise along an exterior surface of the first half member;

creating a second mold for forming a second half member of a drainage channel that features (i) an overhang extending away from the second half member along the length of the second half member, wherein the overhang features alternating recesses and protrusions at regular distances along the length of the overhang, and (ii) a groove extending lengthwise along an exterior surface of the second half member;

pouring a forming composition into the molds to form the first half member and the second half member;

joining the first half member and the second half member together by the recesses of the first half member receiving the protrusions of the second half member and the recesses of the second half member receiving the protrusions of the first half member;

joining the overhangs of the first half member and the second half member to create an upward facing surface, wherein the upward facing surface defines an indentation on the top of the drainage channel; and pouring concrete around the drainage channel to fill with the concrete the grooves and the indentation.

9. The method of manufacturing drainage channels according to claim 8, wherein the first and second half members each comprise first and second ends, wherein the first end of the first half member corresponds to the first end of the second half member and the second end of the first half member corresponds to the second end of the second half member, wherein the first end of the first half member defines a projection and the second end of the first half member defines a depression, wherein the first end of the second half member defines a depression and the second end of the second half member defines a projection and further comprising:

providing a pair of joined first and second half members comprising first and second drainage channel segments, and joining the first and second drainage channel segments by inserting the projection on the first end of the first half member of the first drainage channel segment into the depression on the second end of the first half member of the second drainage channel segment and by inserting the projection on the second end of the second half member of the second drainage channel segment into the depression on the first end of the second half member of the first drainage channel segment.

* * * * *